US009556609B2

(12) United States Patent
Nakamura et al.

(10) Patent No.: US 9,556,609 B2
(45) Date of Patent: Jan. 31, 2017

(54) SLIDING SEISMIC ISOLATION DEVICE

(71) Applicants: Nippon Steel & Sumikin Engineering Co., Ltd., Tokyo (JP); Toray Industries, Inc., Tokyo (JP)

(72) Inventors: Hideji Nakamura, Tokyo (JP); Koji Nishimoto, Tokyo (JP); Yuki Ninomiya, Shiga (JP); Hiroshi Tsuchikura, Shiga (JP); Koji Sugano, Shiga (JP)

(73) Assignees: Nippon Steel & Sumikin Engineering Co., Ltd, Tokyo (JP); Toray Industries, Inc., Tokyo (JP)

( * ) Notice: Subject to any disclaimer, the term of this patent is extended or adjusted under 35 U.S.C. 154(b) by 38 days.

(21) Appl. No.: 14/413,442

(22) PCT Filed: Jul. 10, 2014

(86) PCT No.: PCT/JP2014/068406

§ 371 (c)(1),
(2) Date: Jan. 8, 2015

(87) PCT Pub. No.: WO2015/012115

PCT Pub. Date: Jan. 29, 2015

(65) Prior Publication Data

US 2016/0215495 A1 Jul. 28, 2016

(30) Foreign Application Priority Data

Jul. 25, 2013 (JP) ..... 2013-154587

(51) Int. Cl.
*E04B 1/98* (2006.01)
*E04H 9/02* (2006.01)

(52) U.S. Cl.
CPC ..... *E04B 1/985* (2013.01); *E04H 9/021* (2013.01); *E04H 9/024* (2013.01)

(58) Field of Classification Search
CPC ..... E04B 1/985; E04B 1/98; E04H 9/02; E04H 2009/026; E01D 19/04
(Continued)

(56) References Cited

U.S. PATENT DOCUMENTS 3,337,222 A * 8/1967 Smith ..... F16J 15/46 277/350
4,644,714 A * 2/1987 Zayas ..... E04H 9/021 248/562
(Continued)

FOREIGN PATENT DOCUMENTS

JP 04-101474 4/1992
JP 2002-213101 7/2002
(Continued)

*Primary Examiner* — Brian Glessner
*Assistant Examiner* — Paola Agudelo
(74) *Attorney, Agent, or Firm* — McCarter & English, LLP

(57) ABSTRACT

Provided is a high-performance sliding seismic isolation device with a slider that realizes a contact pressure of 60 MPa. The device includes an upper shoe 1 and a lower shoe (2) having sliding surfaces 1*a* and 2*a* with curvatures, respectively; and a columnar steel slider (7) disposed between the upper shoe (1) and the lower shoe (2), the slider having an upper surface 4*a* and a lower surface 4*b* that are in contact with the upper and lower shoes, respectively, and have curvatures. The upper surface 4*a* and the lower surface 4*b* of the slider (7) have double-woven fabric layers (5) and (6), respectively, each double-woven fabric layer containing PTFE fibers and fibers with higher tensile strength than that of the PTFE fibers, and the PTFE fibers being arranged on the sides of the sliding surfaces 1*a* and 2*a* of the upper shoe (1) and the lower shoe (2).

6 Claims, 6 Drawing Sheets

(58) Field of Classification Search
USPC ..... 52/167.9
See application file for complete search history.

(56) References Cited

U.S. PATENT DOCUMENTS 6,021,992 A * 2/2000 Yen ..... E04H 9/021 248/560
6,125,977 A * 10/2000 Nekomoto ..... E04B 1/985 188/378
6,688,051 B2 * 2/2004 Tsai ..... E01D 19/04 248/636
8,307,586 B2 * 11/2012 Tsai ..... E04H 9/023 248/562
8,926,180 B2 * 1/2015 Bradford ..... E04H 9/022 267/141.1
9,175,468 B1 * 11/2015 Tsai ..... E04B 1/985
2005/0147436 A1 * 7/2005 Koyama ..... G03G 15/206 399/329
2005/0241245 A1 * 11/2005 Tsai ..... E04H 9/023 52/167.1
2006/0174555 A1 * 8/2006 Zayas ..... E04H 9/023 52/167.4
2010/0095608 A1 * 4/2010 Marioni ..... E04H 9/023 52/167.4
2011/0227265 A1 * 9/2011 Fujita ..... E04H 9/023 267/140.13
2012/0178328 A1 * 7/2012 Ogoe ..... C08J 5/048 442/172
2015/0219156 A1 * 8/2015 Okubo ..... F16C 33/208 442/237

FOREIGN PATENT DOCUMENTS

JP 2008-045722 2/2008
JP 2008-150724 7/2008
WO 2009054339 4/2009

* cited by examiner

SLIDING SEISMIC ISOLATION DEVICE

TECHNICAL FIELD

The present invention relates to a sliding seismic isolation device including upper and lower shoes and a slider interposed between them.

BACKGROUND ART

In Japan, which is an earthquake-prone country, a variety of quake resistant techniques, seismic isolation techniques, and vibration control techniques, such as techniques against seismic force and techniques for reducing seismic force on buildings, have been developed for a variety of constructions, such as buildings, bridges, elevated roads, and single-family houses, and have been applied to a variety of constructions.

In particular, seismic isolation techniques, which are the techniques for reducing seismic force on constructions, can effectively reduce vibrations in constructions when earthquakes occur. According to the seismic isolation techniques, a seismic isolation device is provided between a base, which is a lower structure, and an upper structure so that transmission of vibration of the base, which occurs due to an earthquake, to the upper structure is reduced and vibration of the upper structure is thus reduced. Thus, the structure stability is ensured. Such a seismic isolation device is effective not only when an earthquake occurs but also for reducing the influence of traffic vibration, which always acts upon the construction, on the upper structure.

Examples of seismic isolation devices include devices with a variety of configurations, such as a lead plug-containing laminated rubber bearing device, a high damping laminated rubber bearing device, a device that combines a laminated rubber bearing and a damper, and a sliding seismic isolation device. Above all, the sliding seismic isolation device will be exemplarily described with reference to its general structure. A sliding seismic isolation device typically includes upper and lower shoes each having a sliding surface with a curvature, a columnar slider interposed between the upper and lower shoes and having upper and lower surfaces that are in contact with and have the same curvatures as the upper and lower shoes, respectively. Such a sliding seismic isolation device is also referred to as a seismic isolation device with slidable upper and lower spherical surfaces or a double-concave seismic isolation device.

In this type of seismic isolation device, the operation performance of the upper and lower shoes is dominated by the coefficient of friction between the upper and lower shoes and the slider interposed between them or by frictional force that corresponds to the coefficient of friction multiplied by the weight.

By the way, in the conventional sliding seismic isolation device, the reference contact pressure of a slider is less than or equal to 20 MPa. Therefore, when the weight of a construction is increased by an increase in the height thereof or the like, there is no way other than increasing the size of the sliding seismic isolation device correspondingly so that the device has planar dimensions that can withstand the load of the construction. This results in lower cost competitiveness of the device in comparison with other types of seismic isolation devices, such as laminated rubber seismic isolation devices. Thus, such a sliding seismic isolation device has come to be used less frequently.

It should be noted that when a slider formed of steel is applied, the slider can be machined with high precision as it is mechanically machined. However, as there is a large variation in the coefficient of friction, and as the contact pressure dependence and the velocity dependence of the coefficient of friction are high, the range between the upper and lower limits of the coefficient of friction is large. Thus, the earthquake response is likely to vary, which is problematic. Therefore, even if such a slider can prevent collapse of a building, the slider is difficult to be a constituent member of a high-performance seismic isolation device that can have PML (probable maximum loss) that is close to zero and can cause no damage to furniture and fixtures and the like.

Patent Literature 1 discloses a sliding seismic isolation device including substrates, each of which has a laminated body of fiber woven fabric-reinforced thermosetting synthetic resin, and a slider having surface layer materials that are integrally joined to the upper and lower surfaces of the respective substrates.

Such a slider is formed by superposing plain-woven PTFE fibers or by superposing plain-woven PTFE fibers, a woven fabric, and a plain-woven cotton cloth. A slider with such a structure is expected to have reduced frictional properties derived from PTFE.

However, as is clearly shown in the experimental conditions disclosed in Patent Literature 1, the contact pressure of the slider disclosed in Patent Literature 1 is also 19.6 $N/mm^2$ (19.6 MPa), which is less than 20 MPa. Thus, it would be impossible to solve the problem resulting from the low contact pressure of the slider described above.

CITATION LIST

Patent Literature

Patent Literature 1: JP 4848889 B

SUMMARY OF INVENTION

Technical Problem

The present invention has been made in view of the foregoing problems. It is an object of the present invention to provide a high-performance sliding seismic isolation device with a slider that realizes a contact pressure of 60 MPa.

Solution to Problem

In order to achieve the object, the sliding seismic isolation device in accordance with the present invention includes an upper shoe and a lower shoe, the upper and lower shoes each having a sliding surface with a curvature; and a columnar steel slider disposed between the upper and lower shoes, the slider having an upper surface and a lower surface that are in contact with the upper and lower shoes, respectively, and have curvatures. Each of the upper and lower surfaces of the slider has a double-woven fabric layer, the double-woven fabric layer containing PTFE fibers and fibers with higher tensile strength than that of the PTFE fibers, and the PTFE fibers being arranged on the sides of the sliding surfaces of the upper and lower shoes.

In the sliding seismic isolation device of the present invention, a steel slider is used to maintain high contact pressure of the slider, and a double-woven fabric layer is provided on each of the upper and lower surfaces of the slider that are in contact with the sliding surfaces of the upper and lower shoes. More specifically, a double-woven fabric layer, which contains PTFE fibers and fibers with higher tensile strength than that of the PTFE fibers, is fixed on the body of the slider such that the PTFE fibers are arranged on the sides of the sliding surfaces, whereby it is possible to provide a sliding seismic isolation device with high seismic isolation performance while ensuring a contact pressure of 60 MPa.

As the PTFE fibers are arranged on the upper and lower surfaces of the slider on the sides of the sliding surfaces of the upper and lower shoes, it is possible to provide high slidability under a high contact pressure of about 60 MPa.

Further, when a double-woven fabric layer containing PTFE fibers is applied, the PTFE fibers that have relatively low tensile strength and thus have low squash resistance when subjected to a load, are easily squashed when subjected to repetitive vibrations (i.e., pressure sliding force) in the pressed state. However, the squashed PTFE fibers remain in the fibers that have relatively higher tensile strength than that of the PTFE fibers and thus have higher squash resistance, at least some of the PTFE fibers can face the sliding surfaces of the upper and lower shoes. Thus, excellent slidability of the PTFE fibers can be provided. This leads to an improvement of the durability of the sliding seismic isolation device with desired seismic isolation performance.

Examples of the "fibers with higher tensile strength than that of the PTFE fibers" include a variety of resin fibers, such as nylon 6 and polyethylene terephthalate (PET). In particular, PPS fibers with excellent chemical resistance and hydrolysis resistance as well as extremely high tensile strength are desirably used.

The body of the steel slider and the double-woven fabric layers are bonded and fixed to each other with an adhesive. For example, when PPS fibers are used as the fibers with higher tensile strength than that of the PTFE fibers, adhesiveness to the surface of the body of the steel slider can be significantly higher than when the PTFE fibers are used. Thus, it is advantageous to apply double-woven fabric layers such that the PTFE fibers are arranged on the sides of the sliding surfaces of the shoes and the PPS fibers and the like are arranged on the side of the body of the slider.

The inventors have verified that a repetition durability of greater than or equal to 100 repetitions is provided when the contact pressure is 60 MPa and the coefficient μ of kinetic friction is in the range of about 4 to 6%(μ=0.04 to 0.06). Accordingly, when the sliding seismic isolation device of the present invention is applied, it is possible to achieve high-performance seismic isolation in which the response acceleration of the top floor of a building is less than or equal to 100 gal.

Further, it has been verified that if the own natural period T when the slider slides on the sliding surfaces is in the range of 4.5 to 8 seconds and the coefficient μ of kinetic friction between the sliding surfaces and the slider is in the range of 0.03 to 0.07, the response shear coefficient CB in response to an earthquake ground motion of level 2 (L2) can be less than or equal to 0.2, and the response displacement δ in response to an earthquake ground motion of level 3 (L3, which is an earthquake ground motion with a level 1.5 times that of level 2) can be less than 80 cm. It should be noted that a response displacement δ that is over 80 cm means that the seismic isolation performance is extremely high. However, as a device that exerts such seismic isolation performance requires an extremely high production cost, producing a device with a response displacement of about 60 cm would be reasonable in terms of the production cost. Thus, a device with a response displacement of less than 80 cm is desirably produced.

More preferably, when the own natural period T is 4.5 seconds, the response displacement δ can be controlled to about 60 seconds if the coefficient μ of kinetic friction is in the range of 0.04 to 0.05; when the own natural period T is 6 seconds, the response shear coefficient CB can be less than 0.15 and the response displacement δ can be less than 70 seconds if the coefficient μ of kinetic friction is in the range of 0.03 to 0.05; and when the own natural period T is 8 seconds, the response shear coefficient CB can be less than 0.15 and the response displacement δ can be less than 70 seconds if the coefficient μ of kinetic friction is in the range of 0.04 to 0.05. All of such ranges can be said to be preferable.

Advantageous Effects of Invention

As can be understood from the foregoing description, according to the sliding seismic isolation device of the present invention, a double-woven fabric layer, which contains PTFE fibers and fibers with higher tensile strength than that of the PTFE fibers, is formed on each of the upper and lower surfaces of a steel slider that are in contact with the sliding surfaces of the upper and lower shoes, respectively, such that the PTFE fibers are arranged on the sides of the sliding surfaces. Accordingly, it is possible to provide a sliding seismic isolation device with high seismic isolation performance while realizing a contact pressure of 60 MPa.

DESCRIPTION OF EMBODIMENTS

Hereinafter, embodiments of a sliding seismic isolation device of the present invention will be described with reference to the drawings.

(Embodiment of Sliding Seismic Isolation Device)

Figure 1:
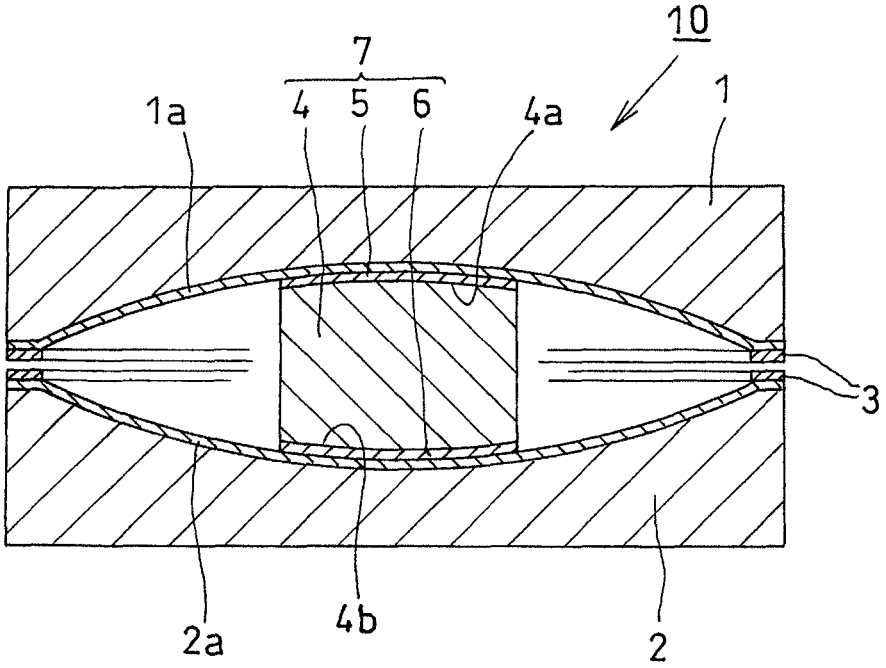
FIG. 1 is a longitudinal sectional view of an embodiment of a sliding seismic isolation device of the present invention.
Figure 2:
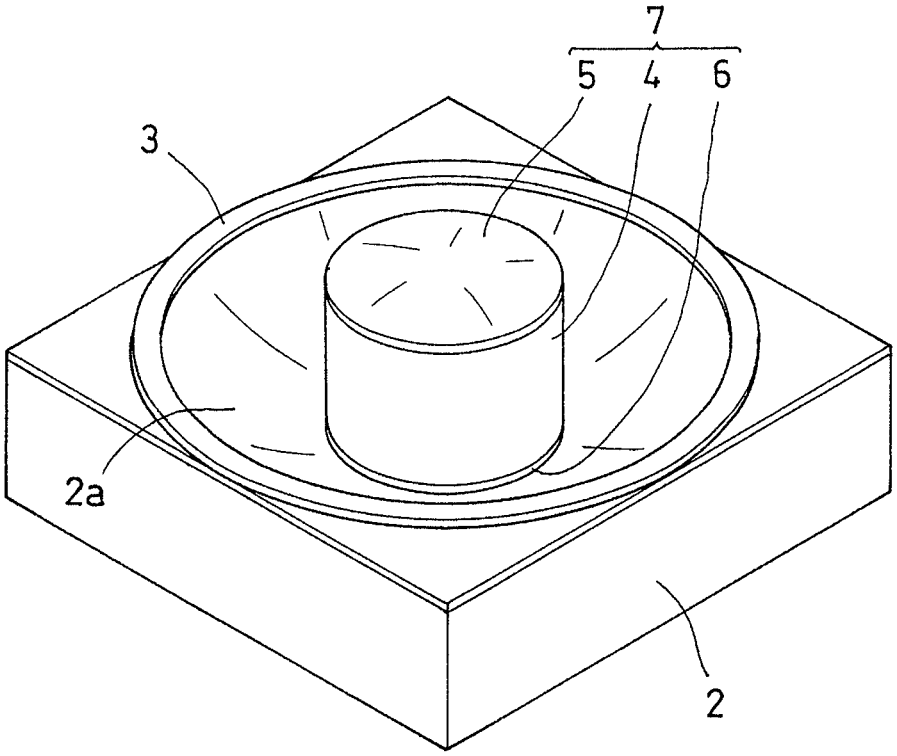
FIG. 2 is a perspective view of the sliding seismic isolation device seen obliquely from above while an upper shoe is removed.

FIG. 1 is a longitudinal sectional view of an embodiment of a sliding seismic isolation device of the present invention. FIG. 2 is a perspective view of the sliding seismic isolation device seen obliquely from above while an upper shoe is removed.

A sliding seismic isolation device 10 shown in the drawing generally includes an upper steel shoe 1, which has a SUS sliding surface 1*a* with a curvature, a lower steel shoe 2, which also has a SUS sliding surface 2*a* with a curvature, and a slider 7, which is interposed between the upper shoe 1 and the lower shoe 2 and has a columnar steel body 4 having an upper surface 4*a* and a lower surface 4*b* that are in contact with the upper shoe 1 and the lower shoe 2 and have the same curvatures as the sliding surfaces 1*a* and 2*a*, respectively.

As shown in FIG. 2, an annular stopper 3 is fixed around the sliding surface 2*a* of the lower shoe 2, and an annular stopper 3 is also fixed around the sliding surface 1*a* of the upper shoe 1 (not shown in FIG. 2).

Each of the upper and lower shoes 1 and 2 and the body 4 of the slider 7 is formed of rolled steel for welding (SM490A,B,C, SN490B,C, or S45C), and has a load bearing strength with a contact pressure of 60 MPa.

The upper surface 4*a* and the lower surface 4*b* of the body 4 of the slider 7 have double-woven fabric layers 5 and 6 that are fixed thereon by adhesion, respectively.

Figure 3:
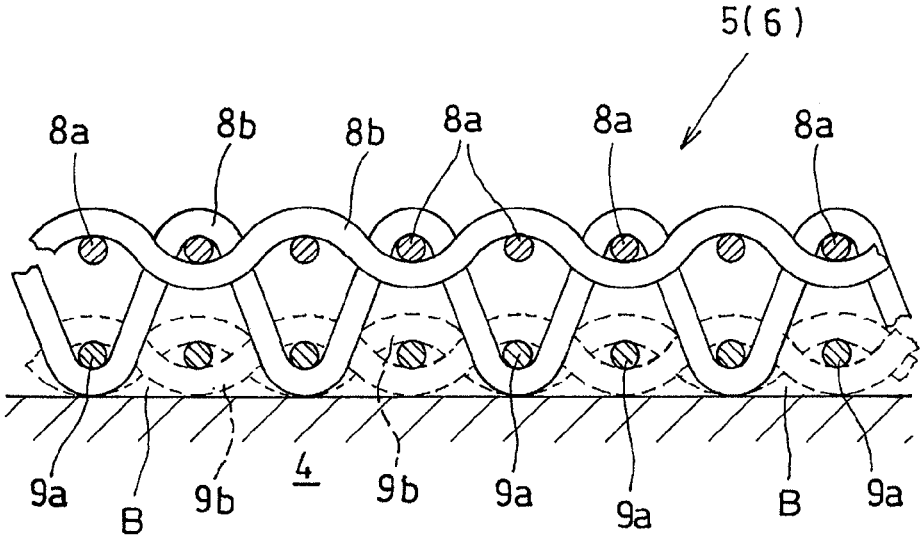
FIG. 3 is a schematic view illustrating the structure of a double-woven fabric layer.

Herein, FIG. 3 is a schematic view illustrating the structure of a double-woven fabric layer. Each of the double-woven fabric layers 5 and 6 shown in the drawing is a double-woven fabric layer containing PTFE fibers and fibers with higher tensile strength than that of the PTFE fibers. The double-woven fabric layers 5 and 6 are fixed on the body 4 such that the PTFE fibers are arranged on the sides of the sliding surfaces 1*a* and 2*a* of the upper and lower shoes, respectively.

Examples of the "fibers with higher tensile strength than that of the PTFE fibers" include fibers of polyamide such as nylon 6,6, nylon 6, or nylon 4,6, polyester such as polyethylene terephthalate (PET), polytrimethylene terephthalate, polybutylene terephthalate, or polyethylene naphthalate, para-aramid, meta-aramid, polyethylene, polypropylene, glass, carbon, polyphenylenesulfide (PPS), LCP, polyimide, or PEEK. Alternatively, fibers such as thermal bonding fibers, cotton, or wool may also be applied.

Above all, PPS fibers with excellent chemical resistance and hydrolysis resistance as well as extremely high tensile strength are desirably used. Hereinafter, an embodiment in which each of the double-woven fabric layers 5 and 6 is formed of PTFE fibers and PPS fibers will be described as a representative example.

In the structures of the double-woven fabric layers 5 and 6 shown in FIG. 3, weft threads 9*a* of PPS fibers are arranged on the side of the body 4 of the slider 7, and warp threads 9*b* of PPS fibers are woven such that the weft threads 9*a* are woven into the warp threads 9*b*. Weft threads 8*a* of PTFE fibers are arranged above the weft threads 9*a* and the warp threads 9*b* (at the position on the shoe side), and the warp threads 8*b* of PTFE fibers are woven such that the weft threads 8*a* are woven into the warp threads 8*b*. Thus, the PTFE fibers are arranged on the sides of the sliding surfaces 1*a* and 2*a* of the upper and lower shoes, thereby forming the double-woven fabric layers 5 and 6.

Such double-woven fabric layers 5 and 6 are fixed on the body 4 by adhesion via an adhesive B. As the adhesive, an epoxy resin adhesive can be applied. As the PPS fibers have significantly higher adhesion to the surface of the steel body 4 than the PTFE fibers have, it would be advantageous to apply the double-woven fabric layers 5 and 6 such that the PTFE fibers are arranged on the sides of the sliding surfaces 1*a* and 2*a* of the shoes, and the PPS fibers are arranged on the side of the body 4 of the slider 7.

In addition, as the PTFE fibers have relatively low tensile strength, such fibers are easily squashed when subjected to repetitive vibrations (i.e., pressure sliding force) in the state in which the double-woven fabric layers 5 and 6 are pressed. However, the squashed PTFE fibers remain in the fibers that have relatively higher tensile strength than that of the PTFE fibers and thus have higher squash resistance, at least some of the PTFE fibers can face the sliding surfaces 1*a* and 2*a* of the upper and lower shoes 1 and 2. Thus, excellent slidability of the PTFE fibers can be provided. This will be described with reference to FIGS. 4*a* and 4*b*.

Figure 4:
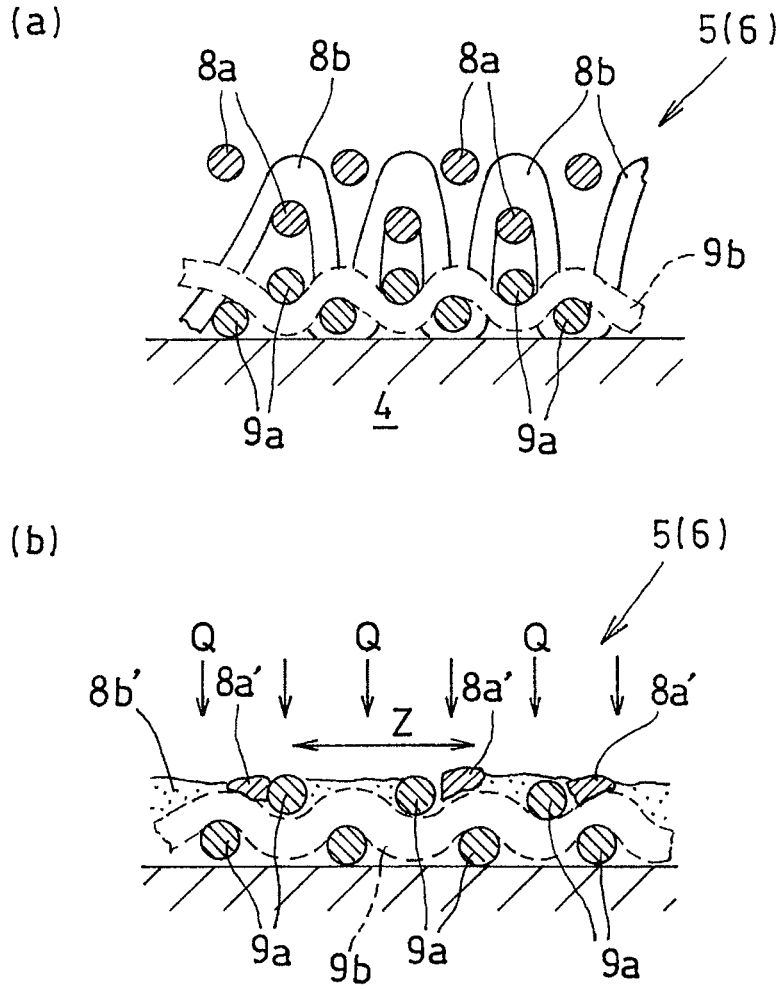
FIG. 4(*a*) is a schematic view showing the state before a double-woven fabric layer is subjected to a load, and FIG. 4(*b*) is a schematic view showing the state in which a double-woven fabric layer is subjected to pressure sliding force.

FIG. 4*a* is a schematic view showing the state before the double-woven fabric layer is subjected to a load, and FIG. 4*b* is a schematic view showing the state in which the double-woven fabric layer is subjected to pressure sliding force.

In the state of FIG. 4*a*, only the weft threads 8*a* and the warp threads 8*b* of PTFE fibers face the sliding surfaces 1*a* and 2*a* of the upper and lower shoes 1 and 2.

When pressure sliding force that allows repeated vibrations Z to act is provided in the state in which the double-woven fabric layers 5 and 6 are subjected to the pressure Q, the weft threads 8*a* and the warp threads 8*b* of the PTFE fibers are squashed through a given number of repetitions. As shown in FIG. 4*b*, weft threads 8*a*' of the squashed PTFE fibers and warp threads 8*b*' of the squashed PTFE fibers enter into the weft threads 9*a* and the warp threads 9*b* of the PPS fibers with high tensile strength and thus high squash resistance.

As is clear from FIG. 4*b*, some of the weft threads 8*a*' and the warp threads 8*b*' of the squashed PTFE fibers, which have entered into the weft threads 9*a* and the warp threads 9*b* of the PPS fibers, face the sides of the sliding surfaces 1*a* and 2*a* of the upper and lower shoes 1 and 2. Thus, excellent slidability of the PTFE fibers can be provided even in the state of FIG. 4*b*. That is, as the slider 7 has the double-woven fabric layers 5 and 6 with the configurations shown in the drawing, it is possible to improve the durability of the sliding seismic isolation device with desired seismic isolation performance.

Herein, Table 1 below shows an example of the materials, specifications, and physical management values of the double-woven fabric layer.

TABLE 1

| Specifications | Item | Physical Management Value | Remarks |
|---|---|---|---|
| PTFE and PPS | Weight per Unit Area (g/m$^2$) | 380 ± 40 | |
| | Thickness (mm) | 0.3 to 0.6 | |
| | Coefficient of Kinetic Friction: μ | 0.01 to 0.1 | Based on Measurement Method of JIS K 7218 |

The own natural period of the sliding seismic isolation device is determined by the radius of curvature of each of the upper and lower surfaces of the slider 7 (and the radius of curvature of each of the sliding surfaces of the upper and lower shoes). When the radius of curvature is 2500 mm, the own natural period T of the sliding seismic isolation device is 4.5 seconds, and when the radius of curvature is 4500 mm, the own natural period T of the sliding seismic isolation device is 6 seconds.

According to the sliding seismic isolation device 10 shown in the drawing, a contact pressure of 60 MPa is realized by the steel slider 7, and the slider 7 has a structure in which the double-woven fabric layers 5 and 6, which contain PTFE fibers and PPS fibers with higher tensile strength than that of the PTFE fibers, are arranged on the upper and lower surfaces of the slider 7, respectively, such that the PTFE fibers are arranged on the sides of the sliding surfaces 1*a* and 2*a* of the upper and lower shoes 1 and 2. Thus, a sliding seismic isolation device with a high seismic isolation effect, which is achieved by the excellent slidability, and high durability can be provided.

[Experiments of Verifying the Repetition Durability of the Double-Woven Fabric Layers and Results Thereof]

The inventors produced the sliding seismic isolation device of the present invention (in which the reference value of the coefficient μ of kinetic friction is 0.045 to 0.05), and conducted repetition durability tests at 20° C. at a rate of 400 mm/sec in the state in which the sliding seismic isolation device is subjected to a load of 60 MPa. Table 2 below and FIG. 5 show each cycle count up to 120 repetitions and fluctuation (measurement value) of the coefficient of kinetic friction.

TABLE 2

| Number of Cycles | Coefficient of Friction | Rate of Change with respect to 3rd Cycle |
|---|---|---|
| 1 | 0.0544 | 1.225 |
| 3 | 0.0444 | 1.000 |
| 10 | 0.0357 | 0.803 |
| 20 | 0.0384 | 0.864 |
| 40 | 0.0372 | 0.838 |
| 60 | 0.0388 | 0.873 |
| 80 | 0.0393 | 0.884 |
| 100 | 0.0398 | 0.896 |
| 120 | 0.0405 | 0.912 |

Figure 5:
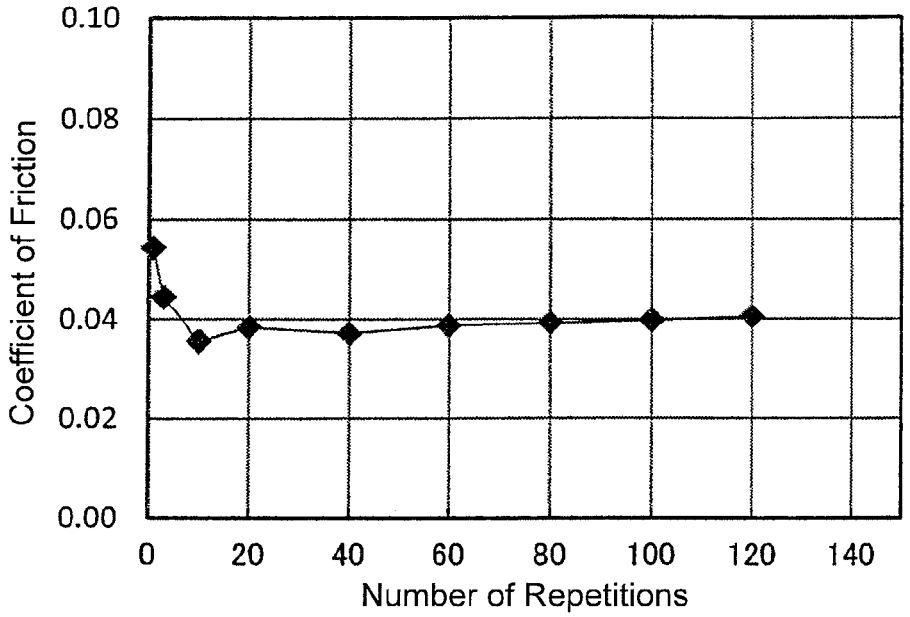
FIG. 5 is a diagram showing the experimental results that verify the repetition durability of a double-woven fabric layer.

Table 2 and FIG. 5 can confirm that frictional heat increases the temperature in accordance with the number of repetitions, and the coefficient of friction tends to decrease with the increase in temperature; however, the temperature increase stops after a given time has elapsed, and conversely, the coefficient of friction tends to slightly increase due to degradation resulting from the repetition. The present test results show that there is only little degradation as the temperature increase is as large as about 40° C. and the coefficient of friction has thus become small.

[Analysis Conducted with Sliding Seismic Isolation Devices with Different Own Natural Periods to Verify the Shear Coefficient and Response Displacement for Each Coefficient of Kinetic Friction, and Results Thereof]

Figure 6:
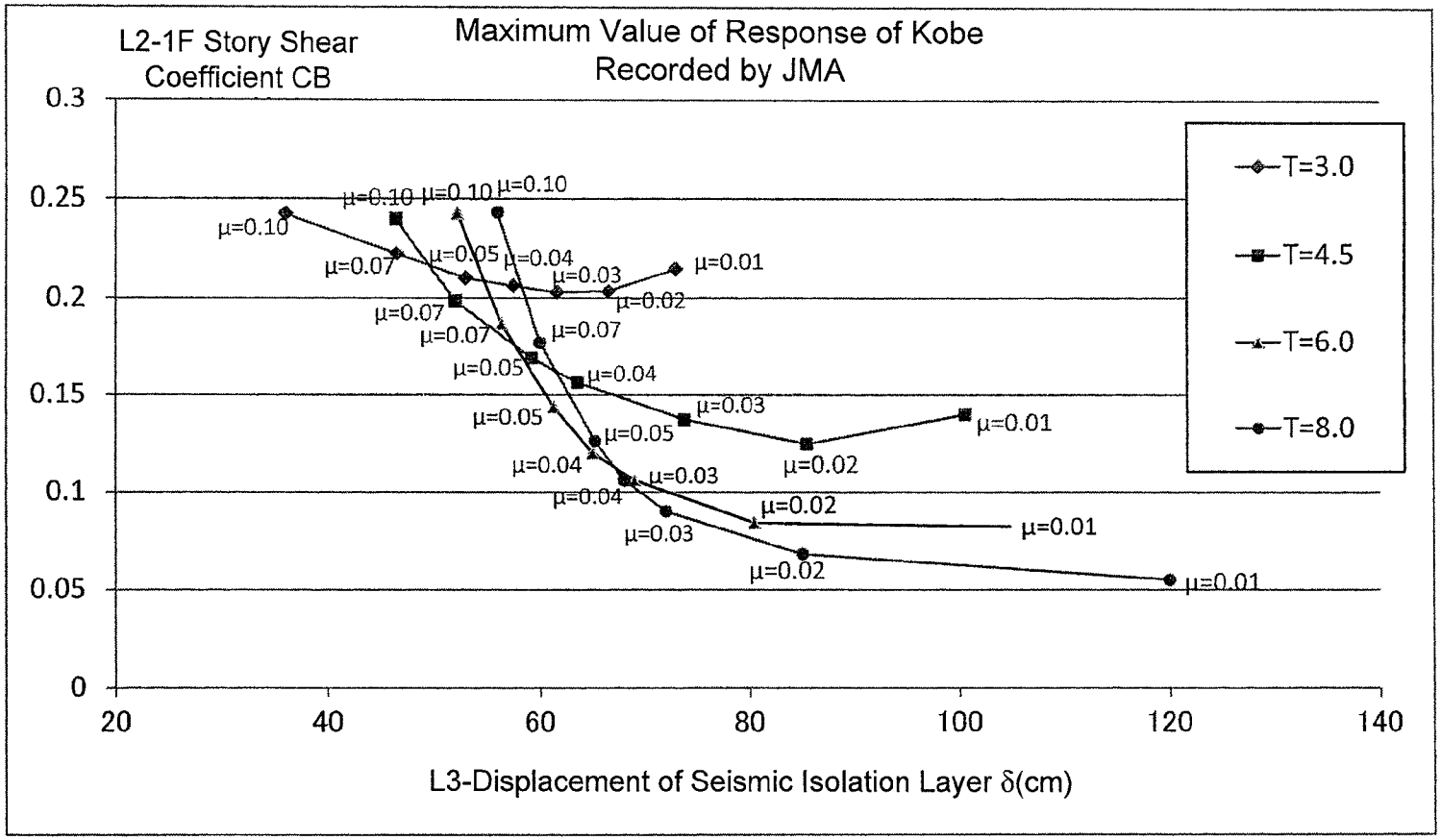
FIG. 6 is a diagram showing the experimental results obtained with sliding seismic isolation devices with different own natural periods, which verify the shear coefficient and response displacement for each coefficient of kinetic friction.

The inventors further modeled a variety of sliding seismic isolation devices with different own natural periods on a computer, and conducted experiments of verifying the shear coefficient and response displacement for each coefficient of kinetic friction for the sliding seismic isolation devices. FIG. 6 shows the experimental results.

In the drawing, symbol L2 represents an earthquake ground motion of level 2, and the shear coefficient CB represents the shear coefficient of the first floor of a multi-level construction model. Symbol L3 represents an earthquake ground motion of level 3, which is an earthquake ground motion with a level 1.5 times that of the earthquake ground motion of level 2 (the response displacement corresponds to the sum of the value in response to L3 and a margin). The response displacement when an earthquake of L3 occurs was used as the response displacement. In the present analysis, the waveforms of the earthquake of the south part of Hyogo prefecture in 1995, recorded by the JMA (Japan Meteorological Agency), was used as the earthquake waves.

FIG. 6 can confirm that a sliding seismic isolation device with an own natural period of T=3.0 seconds has a shear coefficient CB of over 0.2 regardless of the coefficient μ of kinetic friction, and thus has a low seismic isolation effect.

Meanwhile, seismic isolation devices with own natural periods of T=4.5 seconds, 6.0 seconds, and 8.0 seconds each have a response displacement of greater than or equal to 80 cm when the coefficient μ of kinetic friction is less than or equal to 0.02, which is not preferable in terms of the production cost. In addition, the seismic isolation device with each own natural period has a shear coefficient CB of less than 0.2 and a response displacement of less than 80 cm when the coefficient μ of kinetic friction is in the range of 0.03 to 0.07. Thus, with respect to the sliding seismic isolation devices with own natural periods of T=4.5 seconds, 6.0 seconds, and 8.0 seconds, the coefficient μ of kinetic friction is preferably in the range of 0.03 to 0.07.

More specifically, when the own natural period T is 4.5 seconds, the response displacement δ can be controlled to about 60 cm if the coefficient μ of kinetic friction is in the range of 0.04 to 0.05; when the own natural period T is 6 seconds, the response shear coefficient CB can be less than 0.15 and the response displacement δ can be less than 70 cm if the coefficient μ of kinetic friction is in the range of 0.03 to 0.05; and when the own natural period T is 8 seconds, the response shear coefficient CB can be less than 0.15 and the response displacement δ can be less than 70 cm if the coefficient μ of kinetic friction is in the range of 0.04 to 0.05. All of such ranges are more preferable.

Although the embodiments of the present invention have been described in detail with reference to the drawings, specific structures are not limited thereto. Thus, any design changes and the like that may occur within the spirit and scope of the present invention all fall within the scope of the present invention.

REFERENCE SIGNS LIST

1 Upper shoe
1*a* Sliding surface
2 Lower shoe
2*a* Sliding surface
3 Stopper
4 Body (body of slider)
4*a* Upper surface
4*b* Lower surface
5,6 Double-woven fabric layer
7 Slider
8*a* Weft threads of PTFE fibers
8*a*' Weft threads of squashed PTFE fibers
8*b* Warp threads of PTFE fibers
8*b*' Warp threads of squashed PPS fibers
9*a* Weft threads of PPS fibers
9*b* Warp threads of PPS fibers
10 Sliding seismic isolation device

We claim:

1. A sliding seismic isolation device comprising:

an upper shoe and a lower shoe, the upper and lower shoes each having a sliding surface with a curvature; and a columnar steel slider disposed between the upper and lower shoes, the slider having an upper surface and a lower surface that are in contact with the upper and lower shoes, respectively, and have curvatures, wherein each of the upper and lower surfaces of the slider has a double-woven fabric layer, each of the double-woven fabric layers comprising a first layer and a second layer, the first layer comprising polytetrafluoroethylene fibers and the second layer comprising fibers selected from the group consisting of: polyamide fibers, polyester fibers, para-amid fibers, meta-aramid fibers, polyethylene fibers, polypropylene fibers, glass fibers, carbon fibers, polyphenylenesulfide (FPS) fibers, liquid crystal polymer (LCF) fibers, polyimide fibers, polytheretherketone (PEEK) fibers, thermal bonding fibers, cotton and wool;

wherein each of the first layers is arranged in contact with the sliding surfaces of the upper and lower shoes respectively, and each of the second layers is arranged in contact with the upper and lower surfaces of the slider respectively.

2. The sliding seismic isolation device according to claim 1, wherein the fibers selected from the group are PPS fibers.

3. The sliding seismic isolation device according to claim 2, wherein the natural period T when the slider slides on the sliding surfaces is in a range of 4.5 to 8 seconds, and a coefficient μ of kinetic friction between the sliding surfaces and the slider is in a range of 0.03 to 0.07.

4. The sliding seismic isolation device according to claim 3, wherein the coefficient μ of kinetic friction when the natural period T is 4.5 seconds is in a range of 0.04 to 0.05.

5. The sliding seismic isolation device according to claim 3, wherein the coefficient μ of kinetic friction when the natural period T is 6 seconds is in a range of 0.03 to 0.05.

6. The sliding seismic isolation device according to claim 3, wherein the coefficient μ of kinetic friction when the natural period T is 8 seconds is in a range of 0.04 to 0.05.

* * * * *